US006152157A

United States Patent [19]

Jang

[11] Patent Number: 6,152,157

[45] Date of Patent: Nov. 28, 2000

[54] ONE-TOUCH ASSEMBLING COLLAPSIBLE TENT FRAME

[76] Inventor: Jung-Woo Jang, 53-26 Gamsam-dong Dalseo-ku, Daegu, Rep. of Korea

[21] Appl. No.: 09/082,481

[22] Filed: May 21, 1998

[30] Foreign Application Priority Data

May 23, 1997 [KR] Rep. of Korea ..... 97-11753

[51] Int. Cl.[7] ..... E04H 15/50

[52] U.S. Cl. ..... 135/131; 135/99; 135/126; 135/146; 52/109; 403/109.3; 403/326

[58] Field of Search ..... 135/99, 123, 126, 135/128, 130, 131, 140, 142, 145, 146, 147, 151, 157; 52/109, 646, 655.1; 406/109.3, 104, 113, 117, 119, 161, 150, 326; 411/41, 46, 48, 57.1

[56] References Cited

U.S. PATENT DOCUMENTS

| | | | |
|---|---|---|---|
| 617,500 | 1/1899 | Ehling | 403/109.3 X |
| 1,081,902 | 12/1913 | Fowzer | 135/142 |
| 1,742,457 | 1/1930 | Wittman | 403/150 X |
| 2,134,301 | 10/1938 | Guggenbuehler | 403/109.3 X |
| 3,265,415 | 8/1966 | Wubbe | 403/150 X |
| 3,933,222 | 1/1976 | Craig, Jr. | 403/109.3 X |
| 4,579,473 | 4/1986 | Brugger | 411/41 X |
| 4,779,635 | 10/1988 | Lynch | 52/109 X |
| 4,846,204 | 7/1989 | Kyu | 135/145 X |
| 4,847,950 | 7/1989 | Coleman | 403/326 X |
| 4,947,884 | 8/1990 | Lynch | 52/109 X |
| 5,195,551 | 3/1993 | Ju | 135/126 |
| 5,275,188 | 1/1994 | Tsai | 135/145 X |
| 5,421,356 | 6/1995 | Lynch | 135/145 |
| 5,490,532 | 2/1996 | Mallookis et al. | 135/99 X |
| 5,499,646 | 3/1996 | Lee | 135/123 X |
| 5,568,675 | 10/1996 | Asami et al. | 411/41 X |
| 5,601,299 | 2/1997 | Yun et al. | 403/150 X |
| 5,638,853 | 6/1997 | Tsai | 135/145 |
| 5,701,923 | 12/1997 | Losi, Jr. et al. | 135/145 X |
| 5,775,860 | 7/1998 | Meyer | 411/41 X |
| 5,921,260 | 7/1999 | Carter | 135/145 |

*Primary Examiner*—Beth A. Stephan
*Assistant Examiner*—Brian E. Glessner
*Attorney, Agent, or Firm*—Griffin & Szipl, P.C.

[57] ABSTRACT

A one-touch assembling collapsible tent frame is disclosed. In the tent frame, the pole ribs are quickly coupled to the tent frame through a one-touch motion. The tent frame is stably supported on the ground since the interval between the lower portions of side poles is wider than that of the upper portions when fully stretching the frame. The tent frame has a slider locking means capable of allowing a slider to be easily and safely locked to or released from a side pole. A tension adjusting means is provided at the center pole for selectively adjusting the spring force of a center pole spring at the outside of the center pole. The center pole thus tightly and stably stretches and sustains the roof of a canvas or other material of the tent and improves the appearance of the tent even when pitching the tent in the wind.

19 Claims, 15 Drawing Sheets

ONE-TOUCH ASSEMBLING COLLAPSIBLE TENT FRAME

BACKGROUND OF THE INVENTION

1. Field of the Invention

The present invention relates, in general, to collapsible tent frames and, more particularly, to a one-touch assembling collapsible tent frame suitable for being easily and quickly assembled or disassembled, tightly stretching and sustaining the roof of a tent by a center pole, stably supporting the tent on the ground, and making pitching or striking the tent easy and quick.

2. Description of the Prior Art

As well known to those skilled in the art, a tent is a collapsible shelter of canvas or other material stretched over and sustained by a frame and is used for camping outdoors or as a temporary structure.

It is preferable for such a tent to be easily and quickly pitched or struck when necessary, so a frame for such tents is preferably designed for being collapsible. In addition, the frame for tents has to be rigid so as to allow a user to use a tent for a lengthy period of time.

Examples of typical collapsible tent frames are referred to U.S. Pat. Nos. 4,641,676 (issued on Feb. 10, 1987), 4,779,635 (issued on Oct. 25, 1988), 4,947,884 (issued on Sep. 14, 1990), 5,244,001 (issued on Sep. 14, 1993), 5,275,188 (issued on Jan. 4, 1994) and 5,421,356 (issued on Jan. 6, 1995).

As shown in FIGS. 1 and 2, the above U.S. patents individually disclose a collapsible tent frame which comprises four side poles 1. The above side poles 1 are adjustable in height and individually have a side pole connector 10 at the top end and a claw 16 at the lower end, thus being held on the ground. A side pole slider 15 is movably fitted over each of the side poles 1 at a position under the connector 10, thus being slidable along the side pole 1 in opposite directions.

The four side poles 1 are coupled to each other into a collapsible structure by a plurality of side pole ribs 2*a* and 2*b* which are coupled to each other into a scissor structure.

In such a case, the first side pole ribs 2*a* are coupled to each other through hinge joints 20 and are hinged to the sliders 15 at the outside ends. Meanwhile, the second side pole ribs 2*b* are coupled to each other through hinge joints 25 and are hinged to the connectors 10 at the outside ends.

A center pole connector 30 is fixed to the lower end of a center pole 3 and is coupled to the joints 20 of the first side pole ribs 2*a* through a plurality of first center pole ribs 2*c*. Meanwhile, a center pole slider 35 is movably fitted over the center pole 3 and is coupled to the joints 25 of the second side pole ribs 2*b* through a plurality of second center pole ribs 2*d*.

In such a case, the first and second center pole ribs 2*c* and 2*d* are coupled to each other into a scissor structure in the same manner as that described for the side pole ribs 2*a* and 2*b*.

In order to strike a tent, the four side poles 1 are moved to the center of the tent frame as shown in FIG. 2, so the center pole 3 moves down in the center pole slider 35 while folding the scissor assemblies of the pole ribs 2*a*, 2*b*, 2*c* and 2*d* and collapsing the tent frame. In such a case, the collapsed frame has a reduced volume, thus allowing a user to easily and conveniently carry the tent. On the other hand, when the four side poles 1 are pushed outwardly at the same time, the center pole 3 moves up in the center pole slider 35 so as to stretch and sustain the roof of the tent, thus pitching the tent.

However, the above collapsible tent frame has the following problems. That is, it is necessary for a user to use separate tools while assembling or disassembling the tent frame, so the tent frame is inconvenient to users. In addition, the tent frame is designed for making the side poles 1 be always vertically positioned on the ground when stretching the frame. Therefore, the tent frame may be unexpectedly collapsed on the ground.

As shown in FIG. 3, the center pole 3 has a telescopic structure, with a compression coil spring 39 being positioned inside a cylinder of the center pole 3 and biasing a tension member of the center pole 3 upwardly so as to effectively stretch and sustain the roof of the tent when pitching the tent. However, the above spring 39 may lose desired elasticity when it is used for a lengthy period of time, so the center pole 1 may fail to tightly stretch and sustain the roof of the tent and spoil the appearance of the tent when the tent is pitched. In such a case, the canvas or other material 100 of the tent may violently flutter in the wind, thus generating noises irritating those around and inside the tent and being sometimes unexpectedly removed from the frame.

FIG. 4 shows a means for selectively stopping the side pole slider 15 on the upper portion of a side pole 1 when pitching the tent. As shown in the drawing, the slider stop means of the above frame comprises a hole 12 which is formed at the upper portion of each side pole 1. A plate spring 13, integrated with a finger-operable stopper 14, is positioned inside the side pole 1 with the stopper 14 being normally and elastically projected from the hole 12.

However, the above slider stop means has the following problems. That is, it is necessary for a user to press the stopper 14 into the hole 12 with a finger tip so as to allow the slider 15 to pass over the stopper 14 while pitching or striking a tent. Therefore, the user's finger may be unexpectedly caught between the slider 15 and the side pole 1, thus being injured. In addition, when the stopper 14 is pressed into the hole 12 by a finger, the stopper 14 may be unexpectedly caught by the edge of the hole 12, thus failing to be elastically projected from the hole 12 even when the finger pressing force is removed from the stopper 14. In such a case, it is necessary for a user to insert a longitudinal member, such as a pipe, into the side pole 1 from the bottom prior to skillfully manipulating the spring 13 so as to project the stopper 14 outside the hole 12. Alternately, the user has to remove the connector 10 from the side pole 1 prior to skillfully manipulating touching the spring 13 so as to project the stopper 14 outside the hole 12. Therefore, such a slider stop means is inconvenient to users.

SUMMARY OF THE INVENTION

Accordingly, the present invention has been made keeping in mind the above problems occurring in the prior art, and an object of the present invention is to provide a one-touch assembling collapsible tent frame, which allows users to easily and quickly couple or separate side and center pole ribs to or from the tent frame through a one-touch motion, thus being convenient to the users.

Another object of the present invention is to provide a one-touch assembling collapsible tent frame, which is stably supported on the ground when fully stretched with the interval between the lower portions of four side poles being wider than that of the upper portions.

A further object of the present invention is to provide a one-touch assembling collapsible tent frame, which is provided with a slider locking means capable of allowing a slider to be easily and safely locked to or released from a side pole and allowing users to easily and quickly lock or release the sliders to or from the side poles without giving any damage to the locking means or being injured by the locking means.

A still another object of the present invention is to provide a one-touch assembling collapsible tent frame, which is provided with a tension adjusting means at the center pole for allowing a user to selectively adjust the spring force of a center pole spring at the outside of the center pole, thus tightly and stably stretching and sustaining the roof of a canvas or other material of the tent and improving the appearance of the tent when pitching the tent in the wind.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
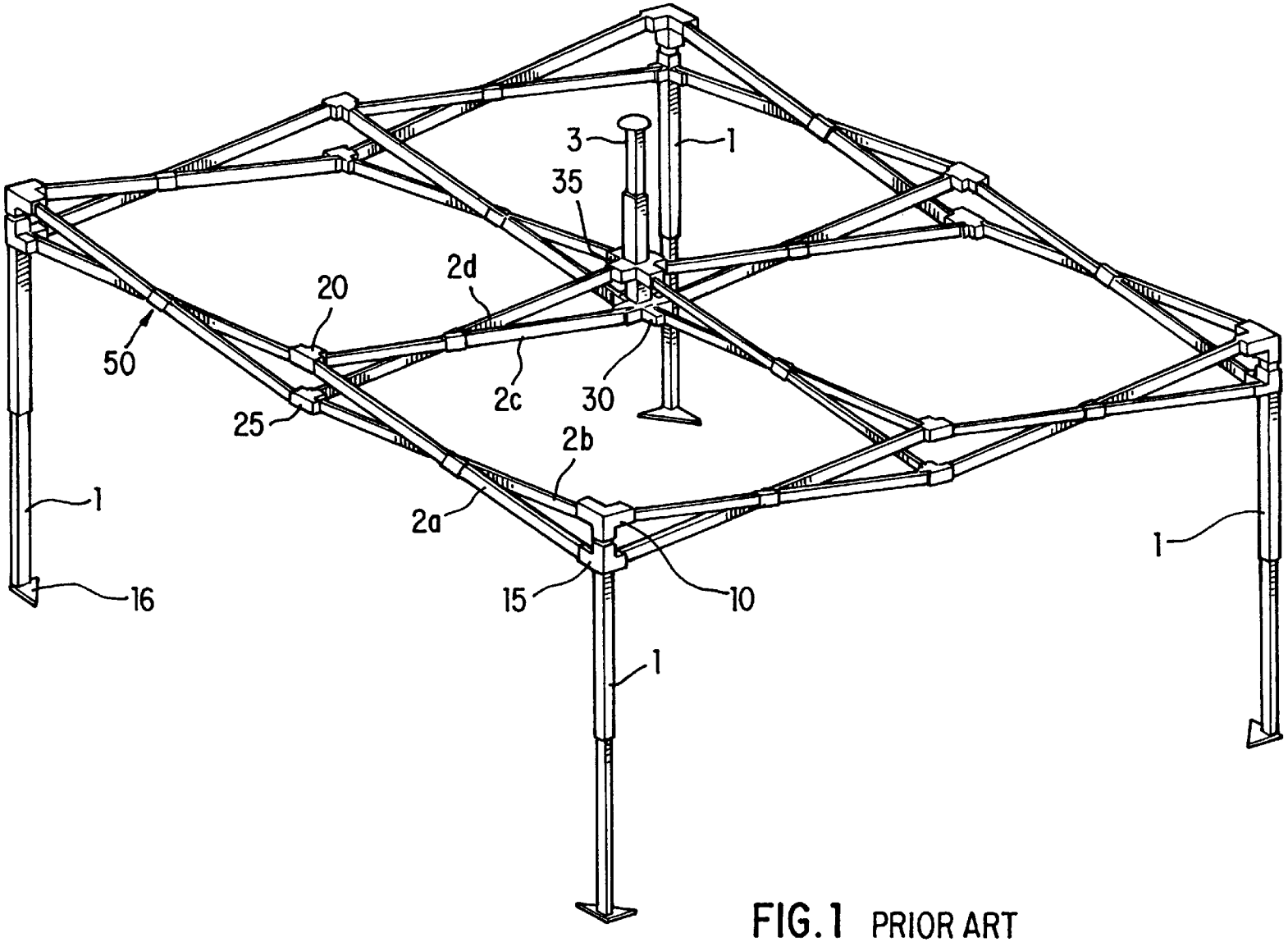
FIG. 1 PRIOR ART
FIG. 1 is a perspective view showing the construction of a typical collapsible tent frame when the frame is fully stretched.
Figure 2:
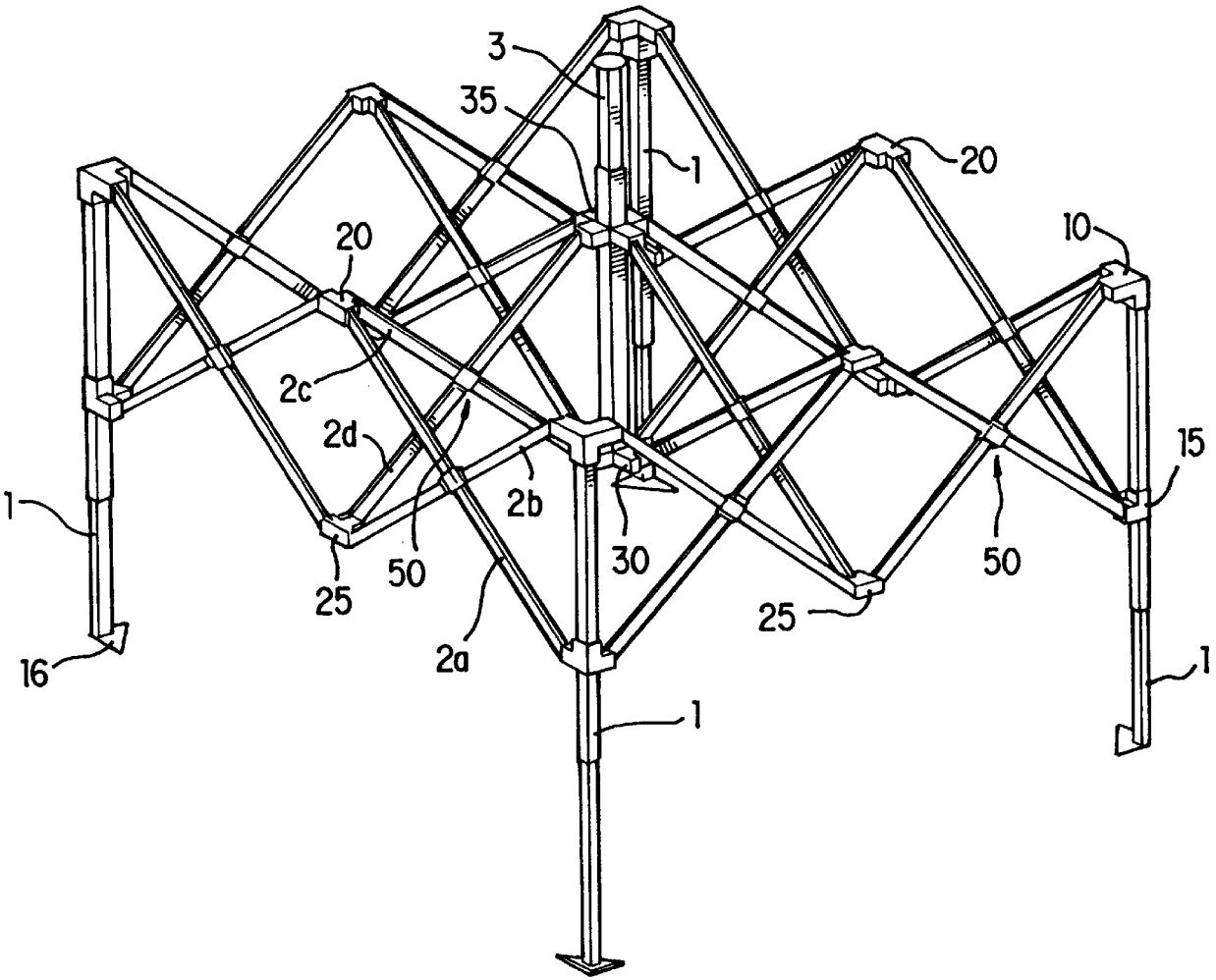
FIG. 2 PRIOR ART
FIG. 2 is a perspective view of the tent frame of FIG. 1 when collapsing the frame.
Figure 3:
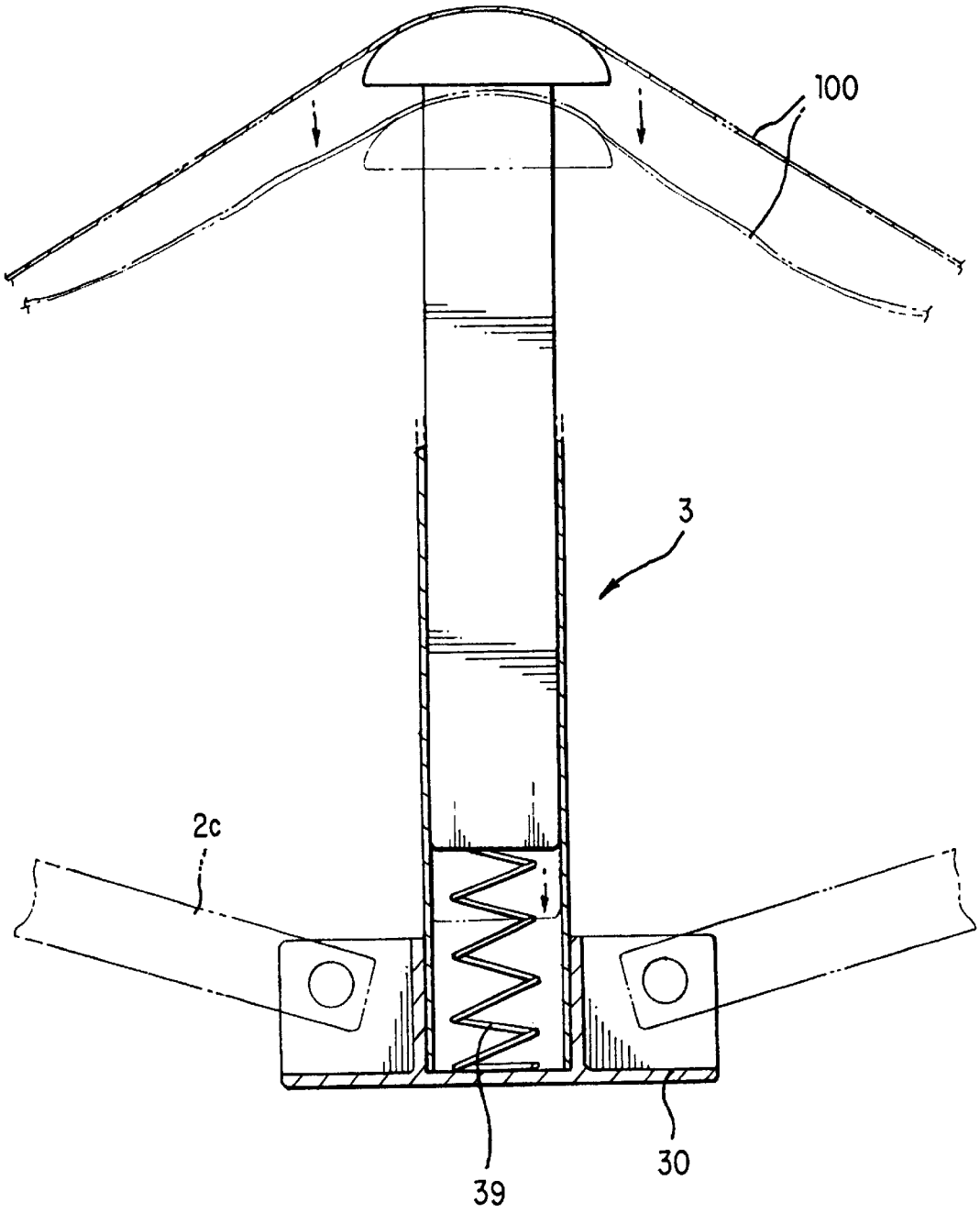
FIG. 3 PRIOR ART
FIG. 3 is a sectional view showing the construction of a spring-biased center pole of the above tent frame.
Figure 4:
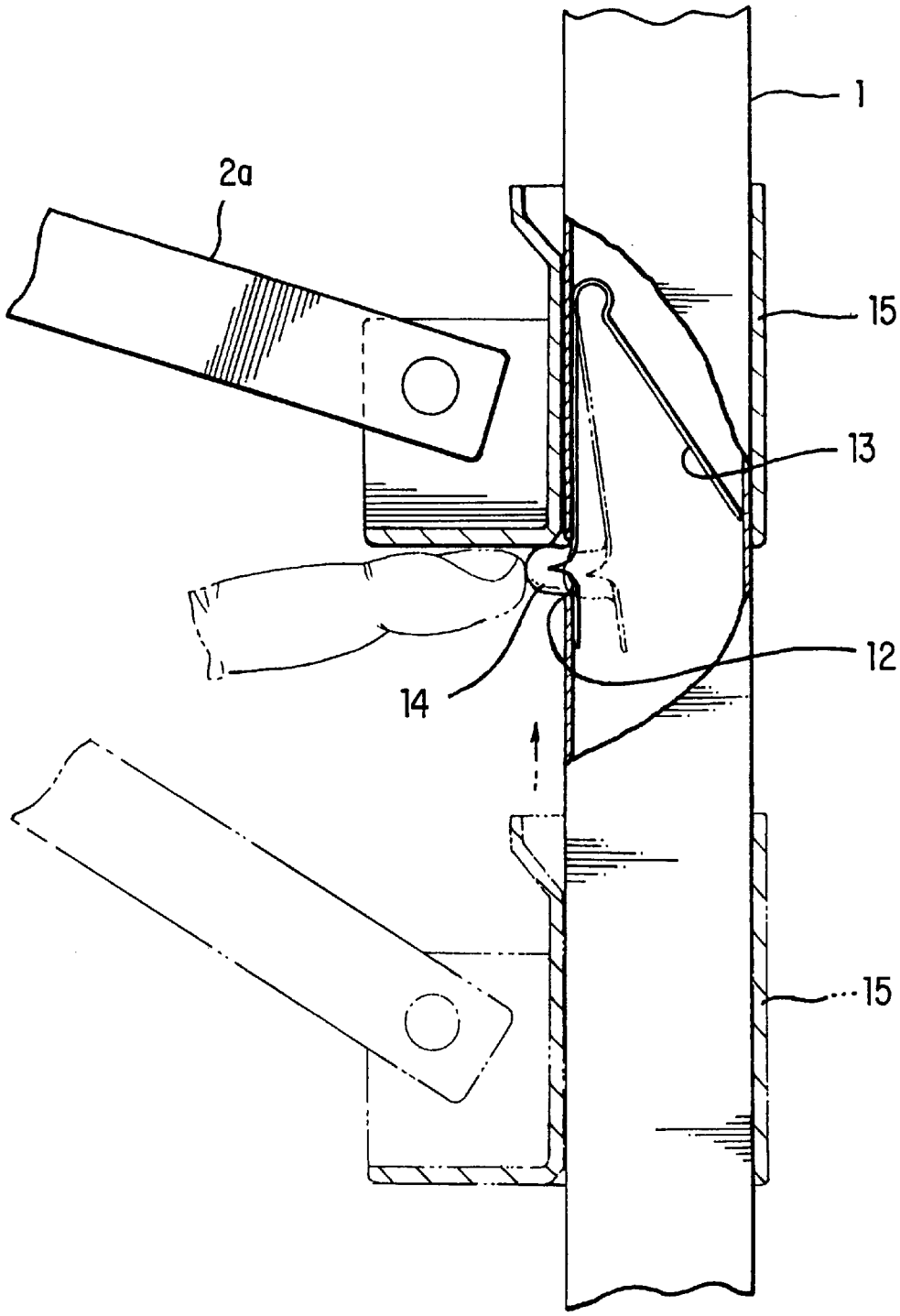
FIG. 4 PRIOR ART
FIG. 4 is a sectional view of a typical means for selectively stopping a side pole slider on the upper portion of a side pole when pitching a tent.
Figure 5A:
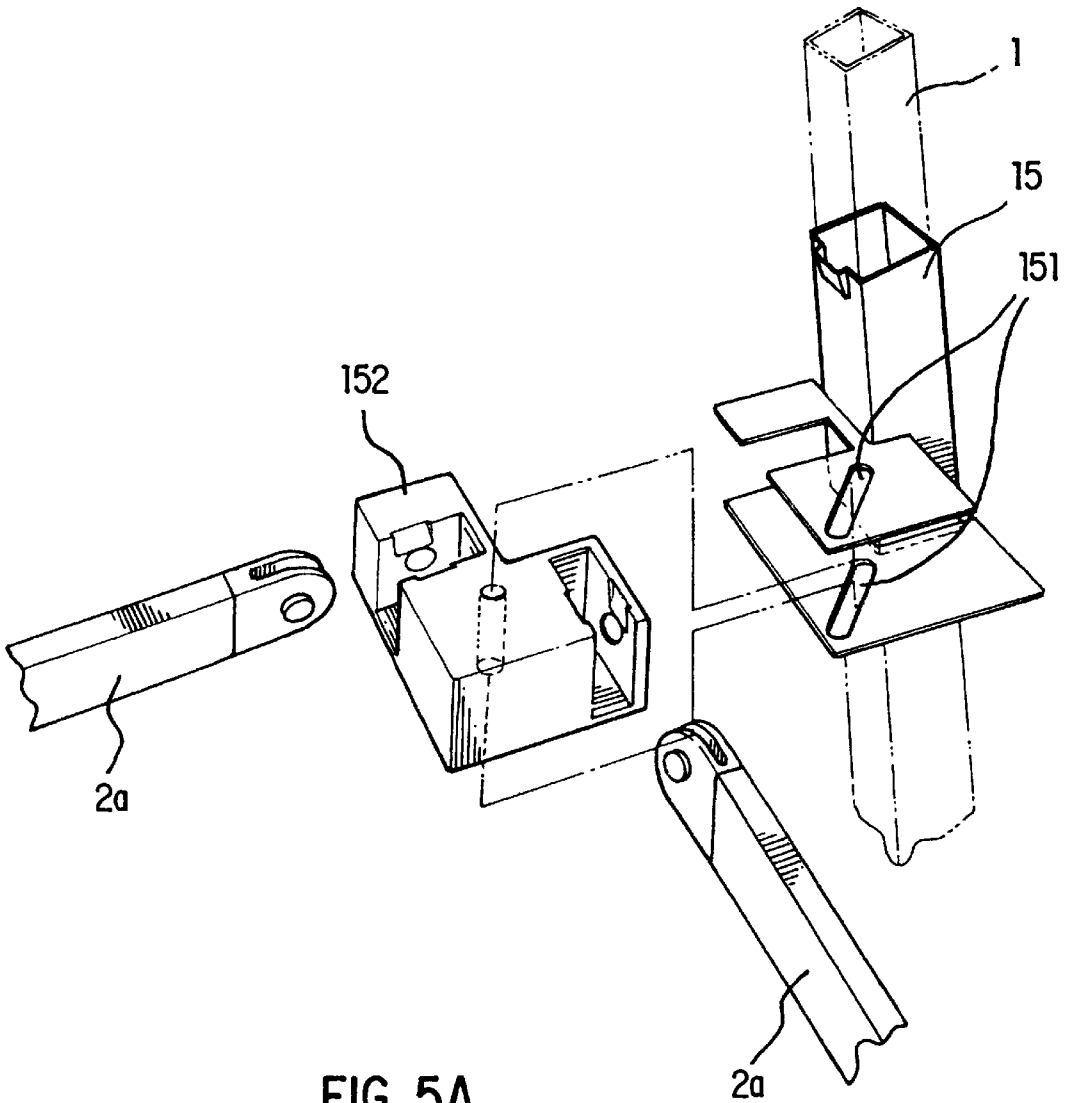
FIG. 5A is an exploded perspective view showing a rib coupling means provided at each side pole slider for coupling two side pole ribs to each side pole slider of a one-touch assembling collapsible tent frame in accordance with an embodiment of the present invention.

FIG. 5A shows a means for coupling two side pole ribs to each side pole slider of a one-touch assembling collapsible tent frame in accordance with an embodiment of this invention. As shown in the drawing, two brackets, individually having a longitudinal guide slit 151, are integrated with each side pole slider 15 of a tent frame with a seat being formed between the two brackets 151. A rib connection block 152, to which two side pole ribs 2*a* are hinged, is seated in the above seat of the two brackets in a way such that the block 152 is movable under the guide of the slits 151. When stretching the frame, the connection blocks 152 of the four side poles 1 slide in the seats of the brackets under the guide of the slits 151, thus allowing the interval between the lower portions of the four side poles 1 to be wider than that of the upper portions and stabilizing the position of the frame on the ground.

Figure 5B:
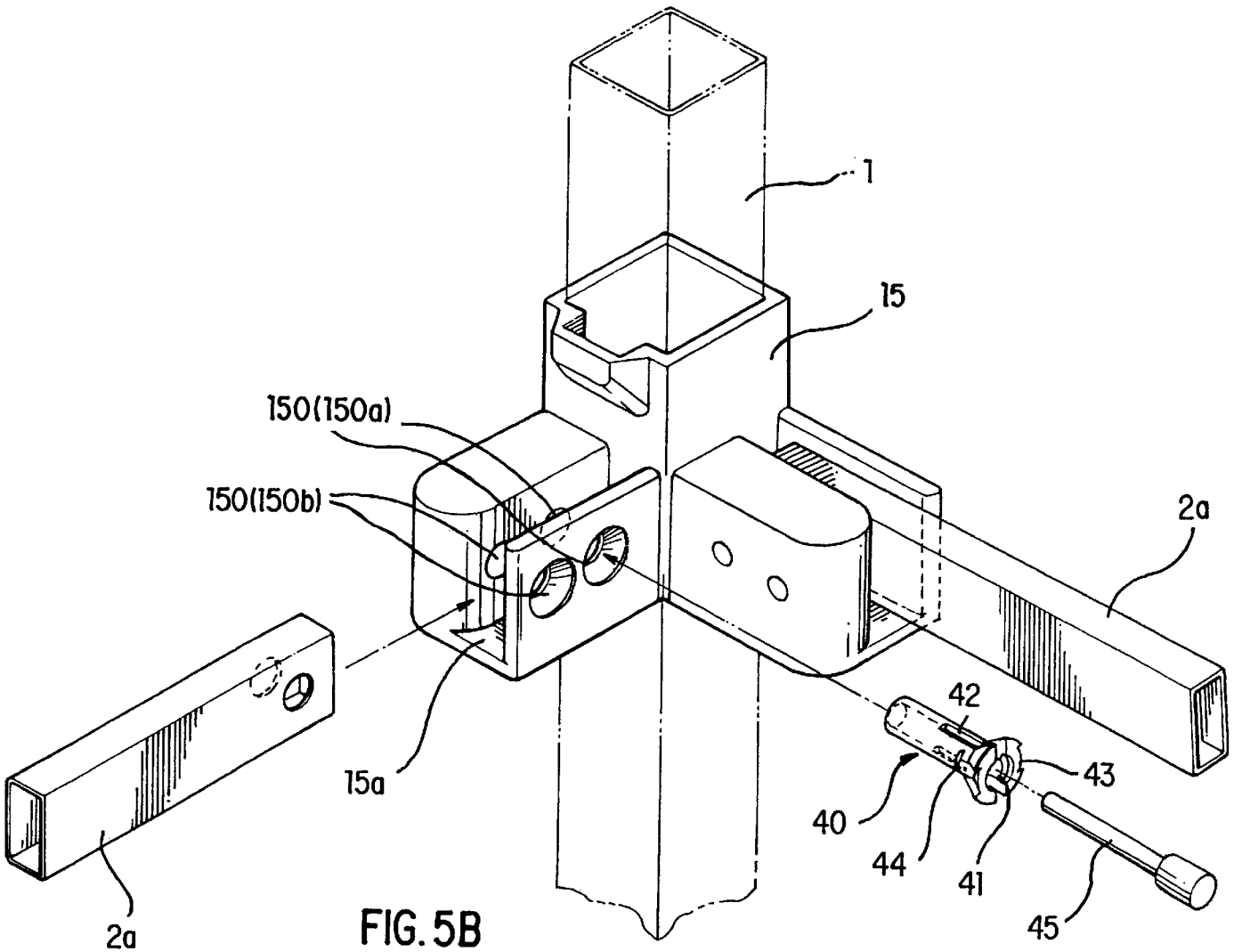
FIG. 5B is an exploded perspective view showing a rib coupling means provided at each side pole slider for coupling two side pole ribs to each side pole slider of the tent frame in accordance with another embodiment of the present invention.

FIG. 5B shows a rib coupling means for coupling two side pole ribs 2*a* to each side pole slider 15 in accordance with another embodiment of this invention. In this embodiment, two connection brackets are integrated with each slider 15. Each of the two connection brackets individually have a slot 15*a* for connecting a rib 2*a* to the slider 15. Two or more pin holes 150 or inside and outside pin holes 150*a* and 150*b* are formed on each connection bracket in a way such that the pin holes 150 are perpendicular to the slot 15*a*, so the ribs 2*a* may be selectively coupled to the inside or outside pin hole 150*a*, 150*b*. When the tent frame is fully stretched with the ribs 2*a* being coupled to the outside pin holes 150*b*, the interval between the lower portions of the four side poles 1 becomes wider than that of the upper portions, thus stabilizing the position of the frame on the ground.

Figure 5C:
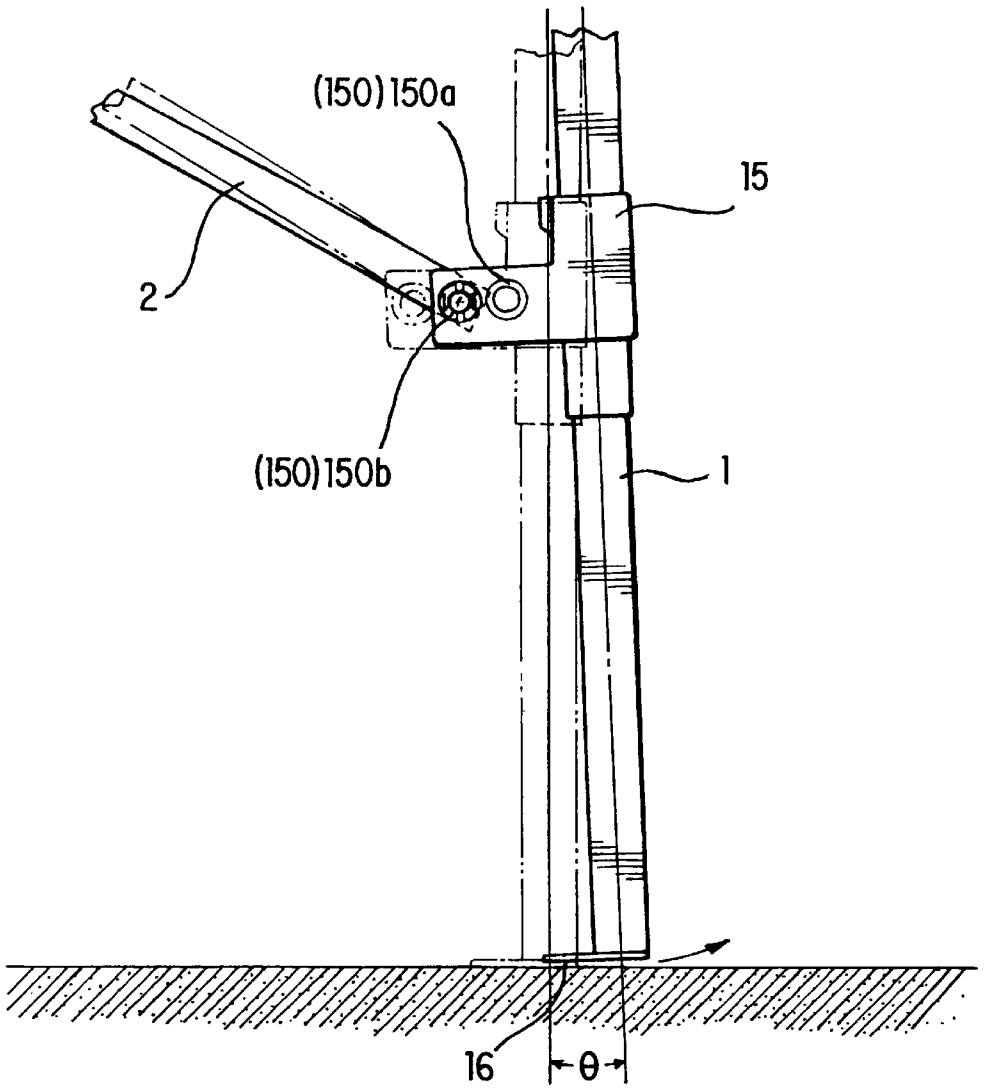
FIG. 5C is a view showing the operational effect of the rib coupling means of FIG. 5B, with the two side pole ribs being coupled to the outside pin holes of the coupling means.

That is, in the embodiment of FIG. 5B, the first side pole ribs 2*a* are normally coupled to the inside pin holes 150*a*. However, when it is necessary for a user to more stably pitch a tent, the ribs 2*a* are removed from the inside pin holes 150*a* prior to being coupled to the outside pin holes 150*b* as shown in FIG. 5C. In such a case, the interval between the lower portions of the side poles 1 becomes wider than that of the upper portions when stretching the tent frame, thus stabilizing the position of the frame on the ground.

Figure 6:
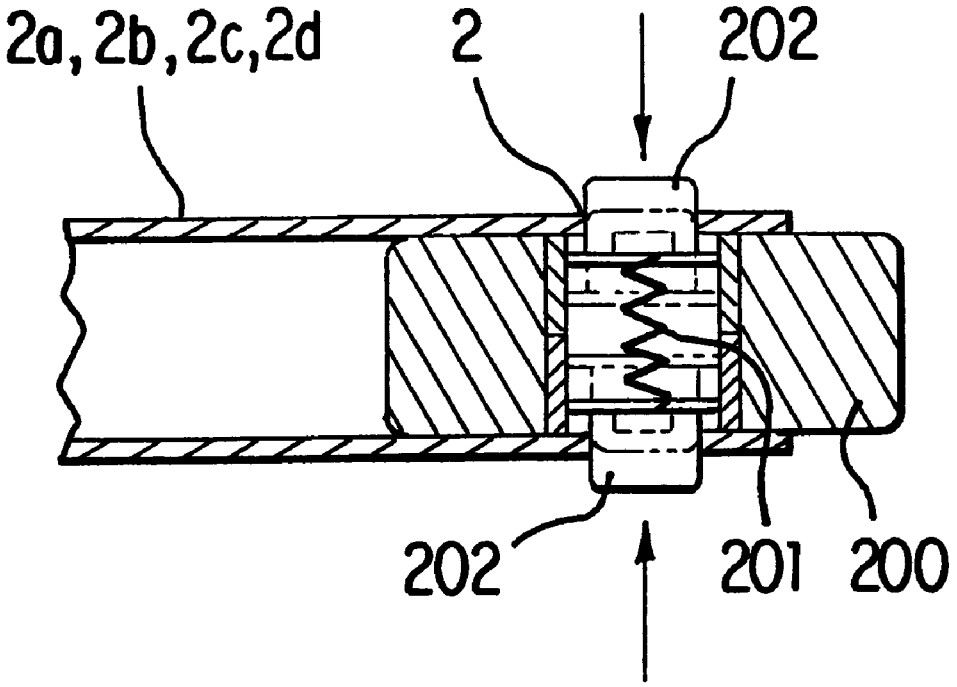
FIG. 6 is a sectional view showing the construction of a spring-biased locking member provided at one end of each rib for detachably coupling the rib to a connector, a slider, or a hinge joint of the tent frame in accordance with an embodiment of this invention.

In order to assemble the ribs 2*a* to 2*d* to the connectors 10 and 30, the sliders 15 and 35 and the hinge joints 20 and 25, a spring-biased locking member 200 may be provided at each end of each rib 2*a*, 2*b*, 2*c* or 2*d* as shown in FIG. 6. In such a case, the locking member 200 comprises two locking buttons 202 biased by a compression coil spring 201 and is seated in a transverse hole 2 of each rib 2*a*, 2*b*, 2*c*, 2*d* in a way such that the spring-biased locking buttons 202 are normally projected from both side surfaces of the rib 2*a*, 2*b*, 2*c*, 2*d* through the hole 2 and are selectively retracted into the hole 2 when they are pressed.

In the above embodiment, when the ribs 2*a* to 2*d* are coupled to the connectors 10 and 30, the sliders 15 and 35 and the hinge joints 20 and 25, the two spring-biased locking buttons 202 of each locking member 200 are retracted into the hole 2 while compressing the spring 201 prior to being locked into a pin hole 150.

Meanwhile, when the ribs 2*a* to 2*d* are disassembled from the connectors 10 and 30, the sliders 15 and 35 and the hinge joints 20 and 25, the two spring-biased locking buttons 202 are pressed by a user, thus being retracted into the hole 2 and allowing the ribs 2*a* to 2*d* to be removed from the pin holes 150.

Figure 7A:
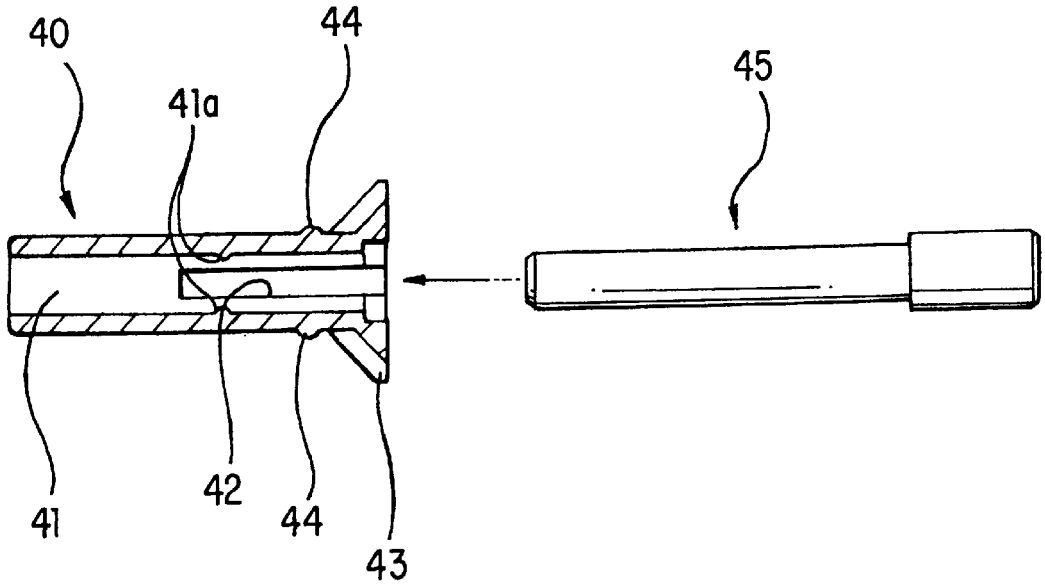
FIG. 7A is an exploded view showing the construction of a socket-type hinge pin used for detachably coupling a rib to a connector, a slider, or a hinge joint of the tent frame in accordance with another embodiment of this invention.
Figure 7B:
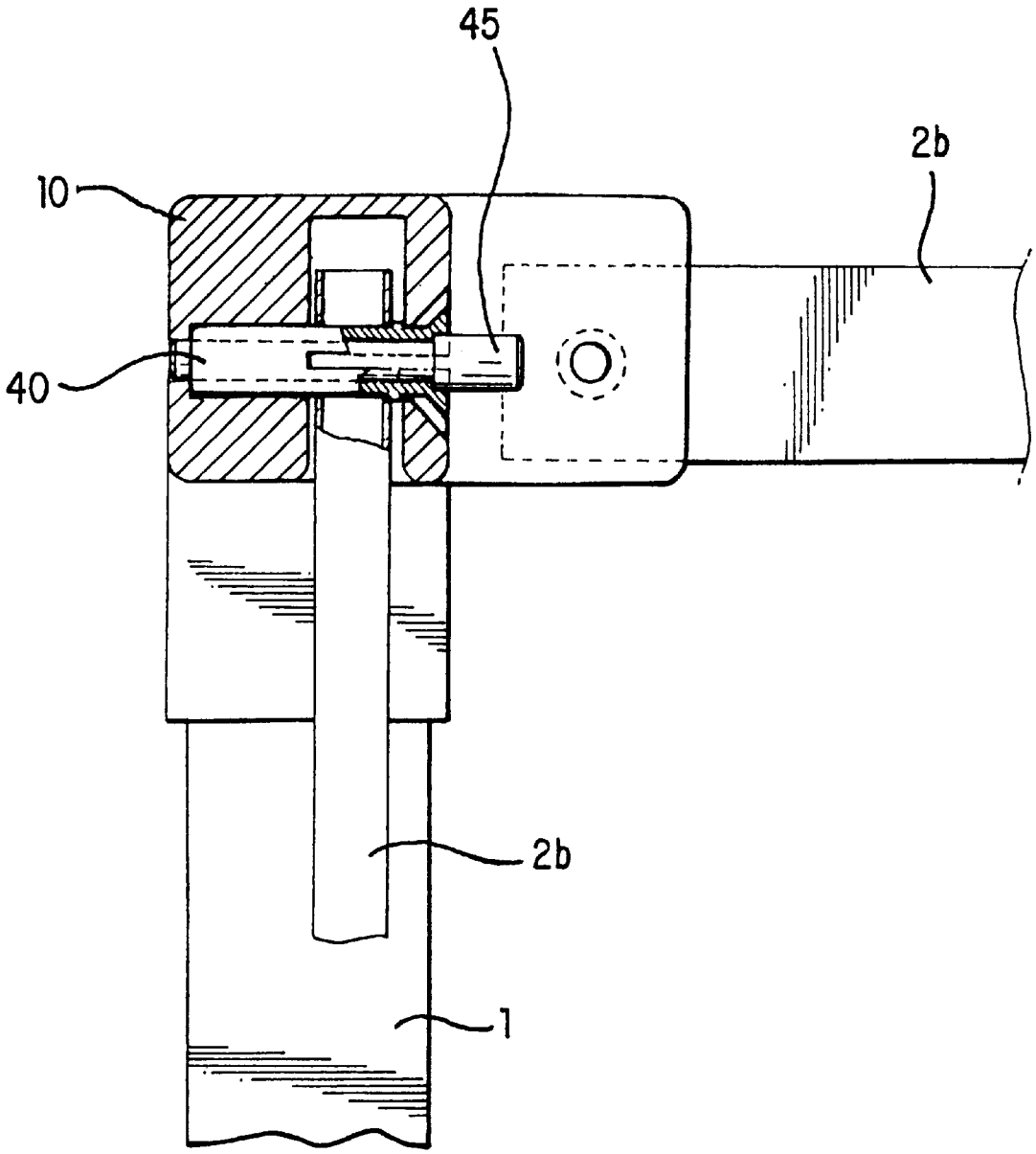
FIG. 7B is a sectional view showing the operational effect of the socket-type hinge pin of FIG. 7A.

In accordance with another embodiment, socket-type hinge pins 40 of FIGS. 7A and 7B are used for coupling the ribs 2*a* to 2*d* to the pin holes 150 of the connectors 10 and 30, the sliders 15 and 35 and the hinge joints 20 and 25. In such a case, when the ribs 2*a* to 2*d* are coupled to the connectors 10 and 30, the sliders 15 and 35 and the hinge joints 20 and 25, the socket-type hinge pins 40, individually having a pin insert hole 41, are inserted into the pin holes 150 prior to inserting a metal pin 45 into the pin insert hole 41 of each socket-type hinge pin 40.

The socket-type hinge pin 40, with both the pin insert hole 41 and a bevel head, are axially slitted at diametrically opposite positions, thus having axial slits 42 capable of allowing the pin 40 to be elastically inserted into the pin hole 150. The above hinge pin 40 also has two slots 43 on the bevel head at diametrically opposite positions, thus being selectively removed from the pin hole 150 when necessary. In order to prevent the hinge pin 40 from being unexpectedly removed from the pin hole, an exterior locking projection 44 is formed on the outside surface of the hinge pin 40.

The hinge pin 40 also has an interior locking projection 41*a* at the pin insert hole 41, thus allowing the metal pin 45 to be tightly fitted into the pin insert hole 41 of the hinge pin 40.

When the ribs 2*a* to 2*d* are coupled to the pin holes 150 of the connectors 10 and 30, the sliders 15 and 35 and the hinge joints 20 and 25 using the above-mentioned socket-type hinge pins 40, each pin 40 is elastically compressed at the slits 43, thus being easily inserted into the pin hole 150. When the ribs 2*a* to 2*d* are completely inserted into the pin holes 150, the exterior locking projection 44 of each pin 40 is caught by the edge of the pin hole 150, so the pin 40 is firmly locked to the pin hole 150 and is prevented from being unexpectedly removed from the hole 150. Thereafter, the metal pin 45 is inserted into the pin insert hole 41 of the hinge pin 40, thus preventing the pin 40 from being unexpectedly compressed at the slits 43. Therefore, the socket-type hinge pins 40 firmly couple the ribs 2*a* to 2*d* to the pin holes 150 of the connectors 10 and 30, the sliders 15 and 35 and the hinge joints 20 and 25.

Figure 8A:
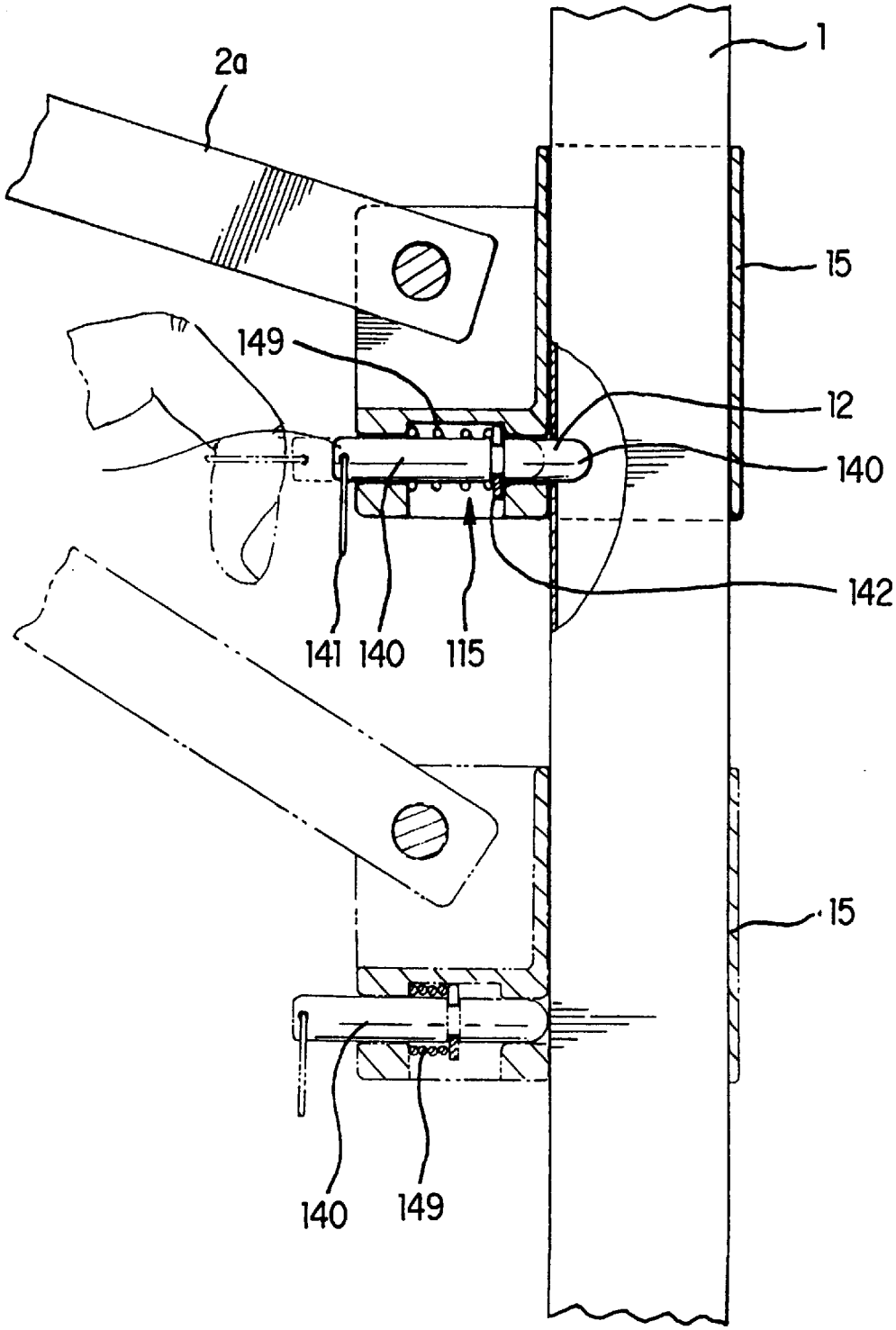
FIG. 8A is a sectional view showing the construction and operation of a slider locking means in accordance with an embodiment of this invention.

FIG. 8A shows a slider locking means in accordance with an embodiment of this invention. In this embodiment, a pin mount 115 is formed at the lower portion of each slider 15 of the side pole 1. A slider locking pin 140, which is provided with both a finger ring 141 at the rear end and a split washer 142 at the front portion and is biased by a compression coil spring 149, is movably fitted into the pin mount 115. The front end of the locking pin 140 is thus elastically projected into a locking hole 12 of the side pole 1, thus selectively locking the slider 15 to the side pole 1.

Figure 8B:
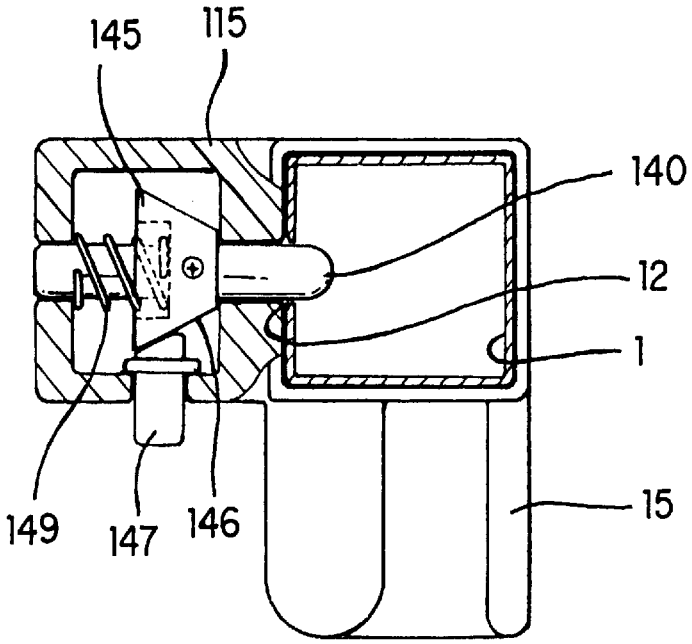
FIG. 8B is a sectional view showing the construction and operation of a slider locking means in accordance with another embodiment of this invention, with a slider locking pin being projected into a pole, thus locking a slider to the pole.

FIG. 8B shows a slider locking means in accordance with another embodiment of this invention. In the above embodiment, the locking pin 140 is integrated with an actuating member 145 at a position in the front of the compression coil spring 149. The above actuating member 145 has a slant surface 146. A push button 147 is provided at the side of the pin mount 115 in a way such that the push button 147 comes into slidable contact with the slant surface 146 of the actuating member 145. When the push button 145 is pushed by a user, the button 145 pushes the slant surface of the actuating member 145 backward, thus retracting the locking pin 14C into the slider 15 while compressing the spring 149.

When the slider 15, with the slider locking means of FIG. 8A or 8B, slides along the side pole 1 so as to stretch the tent frame, the locking pin 140 is retracted into the slider 15 by the side wall of the side pole 1, thus allowing the slider 15 to be slidable along the side pole 1. However, when the tent frame is fully stretched with the pin 140 being aligned with the locking hole 12 of the side pole 1, the pin 140 is elastically projected into the locking hole 12 due to the restoring force of the compression coil spring 149, thus firmly locking the slider 15 to the side pole 1 and stabilizing the tent frame stretched on the ground.

When it is necessary to collapse the tent frame having the slider locking means of FIG. 8A, the locking pin 140 is pulled with a finger catching the finger ring 141, so the pin 140 is retracted from the hole 12 of the side pole 1 while compressing the spring 149 and allows the slider 15 to be slidable downwardly along the side pole 1. Therefore, it is possible to collapse the tent frame.

Figure 8C:
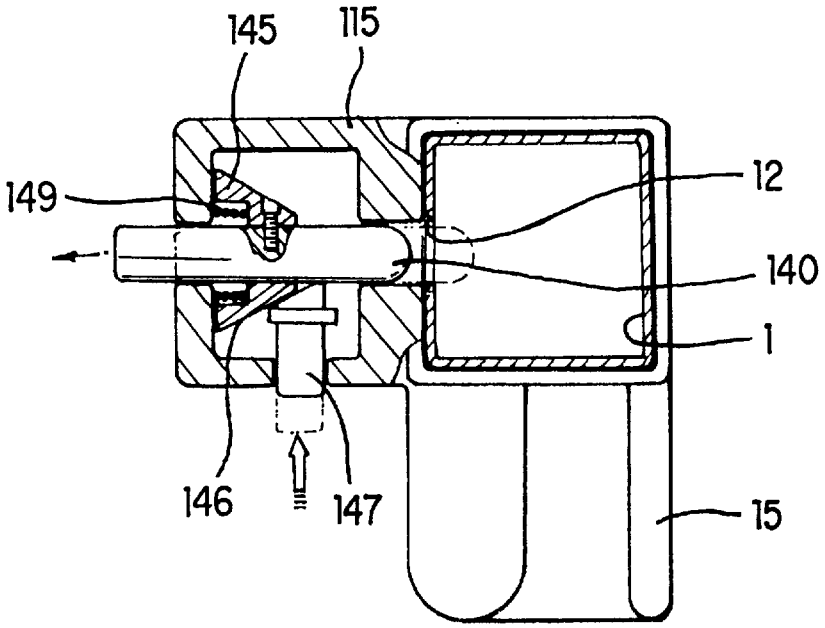
FIG. 8C is a sectional view of the slider locking means of FIG. 8B, with the slider locking pin being retracted into the slider, thus allowing the slider to be slidable along the pole.

In the embodiment of FIG. 8B, the tent frame is collapsed by pushing the bush button 147. That is, when the push button 147, coming into slidable contact with the slant surface 146 of the actuating member 145, is pushed by a user, the push button 147 moves the actuating member 145 to the back while compressing the spring 149, thus retracting the locking pin 140 from the hole 12 of the side pole 1 and allowing the slider 15 to be slidable along the side pole 1 as shown in FIG. 8C.

The center pole 3 is provided with a tension adjusting means for freely adjusting the tension force or elasticity of the compression coil spring 39 at the outside of the center pole 3. Therefore, a user can selectively adjust the tension force of the spring 39 which biases the tension member 36 of the center pole 3 so as to stretch and sustain the roof of the canvas or other material 100.

Figure 9A:
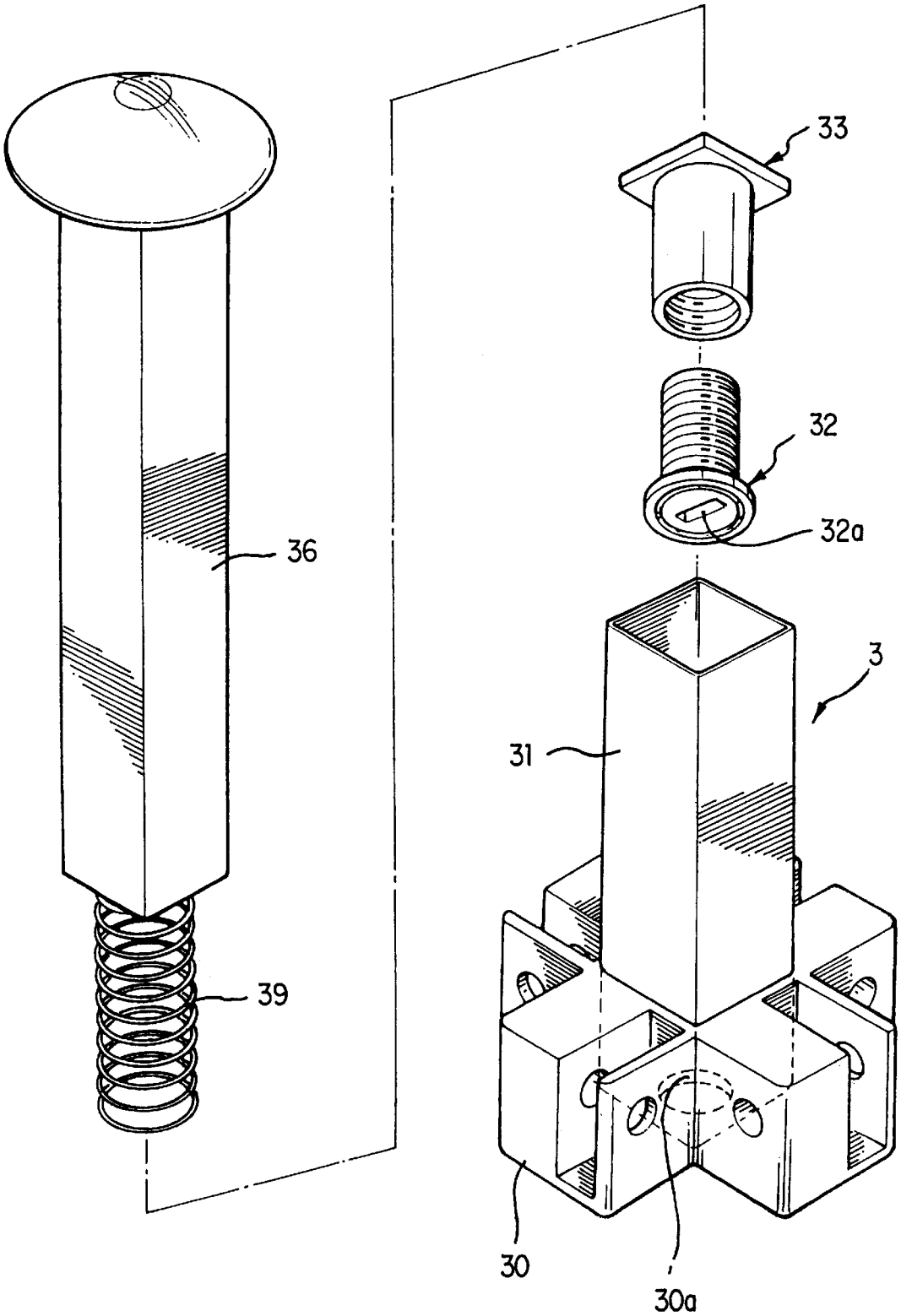
FIG. 9A is an exploded perspective view showing the construction of a tension adjusting means provided at the center pole in accordance with an embodiment of this invention.

FIG. 9A shows a tension adjusting means of the center pole 3 in accordance with an embodiment. In this embodiment, the tension adjusting means comprises a lower center hole 30*a* which is formed at the center of the lower surface of the center pole connector 30. The above connector 30 is integrated with the lower end of a rectangular cylinder 31 of the center pole 3, thus closing the lower end of the cylinder 31. An outer-threaded adjusting body 32, having a tool adjusting groove 32*a* at the lower surface, is threaded into a cylindrical movable member 33. The above movable member 33 is integrated with a rectangular plate at the top end and is received in the rectangular cylinder 31 with a spring 39 being interposed between the lower end of the tension member 36 and the rectangular plate of the movable member 33. Therefore, the movable member 33 is vertically movable inside the cylinder 31 in opposite directions in accordance with a rotating action of the adjusting body 32 which is rotatable by using a tool, such as a screw driver, reaching the tool adjusting groove 32*a* of the adjusting body 32 from the outside of the connector 30 through the lower center hole 30*a* of the connector 30.

Figure 9B:
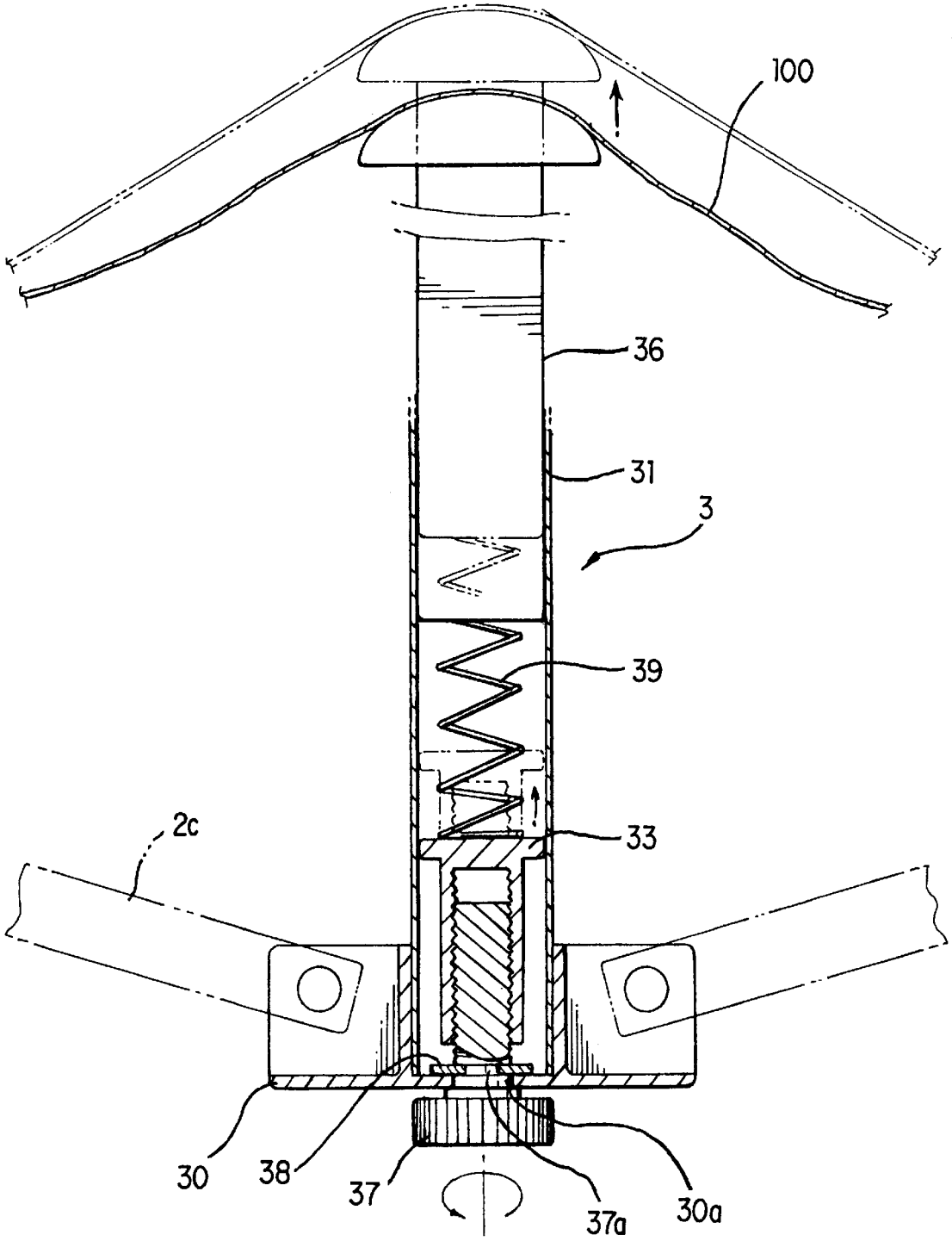
FIG. 9B is a sectional view showing the construction and operation of a tension adjusting means provided at the center pole in accordance with another embodiment of this invention.

FIG. 9B shows a tension adjusting means of the center pole 3 in accordance with another embodiment. In the above embodiment, an adjusting bolt 37, having a washer locking groove 37*a*, is inserted into a lower center hole 30*a* of the connector 30 prior to being brought into engagement with a split washer 38 at the inside of the connector 30, thus being prevented from being unexpectedly removed from the center pole 3. In the cylinder 31 of the center pole 3, the adjusting bolt 37 is threaded into a cylindrical movable member 33. The above movable member 33 is integrated with a rectangular plate at the top end and is received in the cylinder 31 with a spring 39 being interposed between the lower end of the tension member 36 and the rectangular plate of the movable member 33. Therefore, the movable member 33 is vertically movable inside the cylinder 31 in opposite directions in accordance with a rotating action of the adjusting bolt 37 which is rotatable by a user outside the connector 30.

When the tent frame, having the center pole 3 with the tension adjusting means of FIG. 9A, is stretched in order to pitch a tent, the center pole 3 moves upwardly, so the pole 3 stretches and sustains the roof of the canvas or other material 100. When the center pole 3 fails to tightly stretch or sustain the roof of the canvas or other material 100 due to a loosening of the spring 39, the adjusting body 32 is rotated by a tool, such as a screw driver, at the outside of the connector 30, thus moving the movable member 33 upwardly while compressing the spring 39. Therefore, the tension force or elasticity of the spring 39 is increased and allows the tension member 36 of the center pole 3 to tightly stretch and sustain the roof of the canvas or other material 100. In such a case, the tool reaches the tool adjusting groove 32*a* of the adjusting body 32 from the outside of the connector 30 through the lower center hole 30*a* of the connector 30 prior to rotating the adjusting body 32.

When the center pole 3, with the tension adjusting means of FIG. 9B, fails to tightly stretch or sustain the roof of the canvas or other material 100 due to a loosening of the spring 39, the adjusting bolt 37 is rotated by a user at the outside of the connector 30, thus moving the movable member 33 upwardly while compressing the spring 39. Therefore, the tension force or elasticity of the spring 39 is increased and allows the tension member 36 of the center pole 3 to tightly stretch and sustain the roof of the canvas or other material 100.

Figure 10:
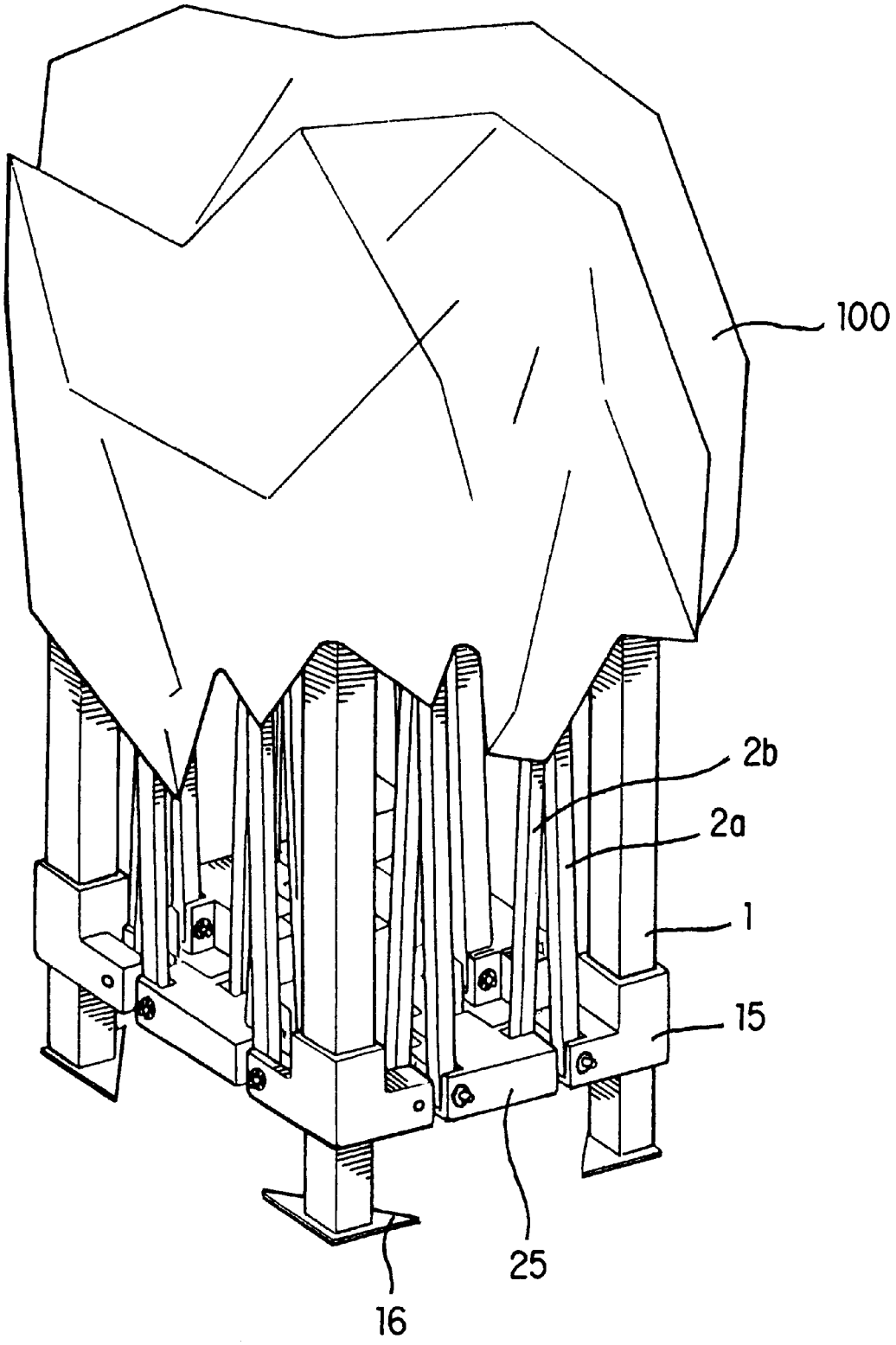
FIG. 10 is a perspective view of a tent provided with the one-touch assembling collapsible tent frame of this invention when the tent frame is completely collapsed.

FIG. 10 is a view of a tent provided with the one-touch assembling collapsible tent frame of this invention when the tent frame is completely collapsed.

As described above, the present invention provides a one-touch assembling collapsible tent frame, which allows users to easily and quickly couple or separate side and center pole ribs to or from the tent frame through a one-touch motion, thus being convenient to the users. The tent frame has a means for detachably coupling two side pole ribs to each side pole slider while allowing the interval between the lower portions of the side poles to be wider than that of the upper portions when fully stretching the tent frame.

In the tent frame, a spring-biased locking member may be provided at each end of the side and center pole ribs for detachably coupling each of the ribs to the tent frame. The above locking member comprises two locking buttons, which are biased by a compression coil spring and are seated in a transverse hole of each rib in a way such that the locking buttons are normally projected from both side surfaces of each rib through the transverse hole and are selectively retracted into the transverse hole when they are pressed.

In another embodiment, the side and center pole ribs are coupled to the tent frame using a plurality of socket-type hinge pins. Each of the socket-type hinge pins has a pin insert hole and is inserted into a pin hole of the tent frame prior to inserting a metal pin into the pin insert hole.

The above tent frame is also provided with a slider locking means capable of allowing a slider to be easily and safely locked to or released from a side pole and allowing users to easily and quickly lock or release the sliders to or from the side poles without giving any damage to the locking means or being injured by the locking means. In the slider locking means, a pin mount is formed at a lower portion of each of the sliders. A spring-biased locking pin is movably fitted into the pin mount in a way such that one end of the locking pin is selectively projected into the locking hole of a side pole, thus selectively locking the slider to the side pole. In an embodiment, a finger ring is provided at a rear end of the locking pin for selectively removing the locking pin from the locking hole of the side pole. A split washer is fitted over a front portion of the locking pin and is biased by a compression coil spring, thus normally biasing the locking pin toward the side pole.

In another embodiment, an actuating member, having a slant surface, is integrated with the locking pin and is biased by a compression coil spring. A push button is provided at a side of the pin mount in a way such that the push button comes into slidable contact with the slant surface of the actuating member. The push button selectively pushes the slant surface of the actuating member and retracts the locking pin from the locking hole of the side pole when the button is pushed.

In the above tent frame, the center pole has a tension adjusting means for selectively adjusting elasticity of the spring at the outside of the center pole, thus allowing the tension member to always tightly stretch and sustain the roof of the tent. In an embodiment, the tension adjusting means comprises a lower center hole formed on a lower surface of the connector. An inner-threaded movable member is received in the cylinder and has a polygonal plate at a top end and supports a tension member with a spring being interposed between the polygonal plate and the tension member. The polygonal plate cooperates with the polygonal cross-section of the cylinder, thus allowing the movable member to be only linearly movable in the cylinder in opposite directions. An outer-threaded adjusting body, having a tool adjusting groove at a lower surface, is threaded into the movable member inside the cylinder, thus being adjustable by a tool passing through the lower center hole prior to reaching the tool adjusting groove. In another embodiment, an adjusting bolt, having a washer locking groove, is inserted into the lower center hole of the connector prior to being locked by a split washer inside the connector. The adjusting bolt is threaded into the movable member, thus being adjustable by a user outside the connector.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A one-touch assembling collapsible tent frame comprising:

a plurality of side poles, a side pole slider movably fitted over each of said side poles, a plurality of side pole ribs having joints and being coupled to said side pole sliders thus coupling said side poles to each other, a center pole coupled to the joints of said side pole ribs through a plurality of center pole ribs, and a detachable coupling movable between a first position coupling two side pole ribs to each side pole slider so that an interval between lower portions of said side poles and upper portions of the side poles are equal and a second position coupling two side pole ribs to each side pole slider so that an interval between lower portions of said side poles is wider than an interval between upper portions of the side poles when the tent frame is fully stretched.

2. The one-touch assembling collapsible tent frame according to claim 1, wherein said detachable coupling comprises, for each side pole:

two brackets, each bracket having a longitudinal guide slit, and mounted to the side pole slider with a seat being formed between the two brackets; and a rib connection block hinged to the two side pole ribs and movably seated in said seat of the two brackets thus coupling the two side pole ribs to the side pole slider, wherein said rib connection block is movable under the guidance of said guide slits of the two brackets from said first position to said second position.

3. The one-touch assembling collapsible tent frame according to claim 1, wherein said detachable coupling comprises, for each side pole:

two brackets mounted to the side pole slider and each bracket having a slot coupling a side pole rib to the slider, each of said brackets also having inside and outside pin holes perpendicular to said slot, thus selectively coupling the side pole rib to the inside or outside pin hole and thus coupling the coupling in the first or second positions, respectively.

4. The one-touch assembling collapsible tent frame according to claim 3, further comprising:

a spring-biased locking member provided at an end of said side pole ribs detachably coupling each of said ribs to one of said inside and outside pin holes, said locking member comprising two locking buttons biased by a compression coil spring and seated in a transverse hole of each rib in a way such that the locking buttons are normally projected from both side surfaces of each rib through said transverse hole and are selectively retracted into the transverse hole when they are pressed.

5. The one-touch assembling collapsible tent frame according to claim 3, wherein:

said side pole ribs are coupled to one of said inside and outside pin holes using socket-type hinge pins, each of said socket-type hinge pins having a pin insert hole and being inserted into a pin hole of the tent frame prior to inserting a metal pin into said pin insert hole.

6. The one-touch assembling collapsible tent frame according to claim 5, wherein each of said socket-type hinge pins further comprises:

a bevel head;

an axial slit allowing the hinge pin to be elastically inserted into a pin hole of the tent frame;

two slots formed on said bevel head at diametrically opposite positions, allowing the hinge pin to be selectively removed from the pin hole; and an exterior locking projection exteriorly formed on said hinge pin so as to be caught by an edge of said pin hole and to prevent the hinge pin from being unintentionally removed from the pin hole.

7. The one-touch assembling collapsible tent frame according to claim 6, wherein each of said socket-type hinge pins further comprises:

an interior locking projection formed on a surface of the pin insert hole, allowing said metal pin to be tightly fitted into the pin insert hole.

8. The one-touch assembling collapsible tent frame according to claim 1, further comprising:

a pin mount formed at a lower portion of each of said side pole sliders, and a spring-biased locking pin movably fitted into said pin mount such that an end of said locking pin is selectively projected into a locking hole formed in a side pole for selectively locking the side pole slider to the side pole.

9. The one-touch assembling collapsible tent frame according to claim 8, further comprising:

a finger ring provided at a rear end of said locking pin for selectively removing the locking pin from the locking hole of the side pole; and a split washer fitted over a front portion of the locking pin and biased by a compression coil spring, for normally biasing the locking pin toward the side pole.

10. The one-touch assembling collapsible tent frame according to claim 8, further comprising:

an actuating member integrated with said locking pin and biased by a compression coil spring, said actuating member having a slanted surface; and a push button provided at a side of the pin mount such that the push button comes into slidable contact with the slant surface of the actuating member, said push button selectively pushing the slant surface of the actuating member and retracting the locking pin from the locking hole of the side pole when the button is pushed.

11. The one-touch assembling collapsible tent frame according to the claim 1:

wherein the center pole is a spring-biased and telescopic center pole coupled to the joints of said side pole ribs through a plurality of center pole ribs, and wherein said center pole comprises:

a cylinder having a polygonal cross-section;

a connector integrated with a lower end of said cylinder so as to close the lower end of the cylinder;

a tension member movably fitted in said cylinder and biased upwardly by a spring, to stretch and sustain a roof of a tent; and tension adjusting means for selectively adjusting an elasticity of said spring, said means disposed outside of the center pole.

12. The one-touch assembling collapsible tent frame according to claim 11, wherein said tension adjusting means comprises:

a lower center hole formed on a lower surface of said connector;

an inner-threaded movable member received in said cylinder and having a polygonal plate at a top end and supporting the tension member with said spring being interposed between the polygonal plate and the tension member, said polygonal plate cooperating with the polygonal cross-section of the cylinder, allowing the movable member to be only linearly movable in the cylinder in opposite directions; and an outer-threaded adjusting body having a tool adjusting groove at a lower surface and threaded into said movable member inside the cylinder, being adjustable by a tool passing through the lower center hole prior to reaching the tool adjusting groove.

13. The one-touch assembling collapsible tent frame according to claim 11, wherein said tension adjusting means comprises:

a lower center hole formed on a lower surface of said connector;

an inner-threaded movable member received in said cylinder and having a polygonal plate at a top end and supporting the tension member with said spring being interposed between the polygonal plate and the tension member, said polygonal plate cooperating with the polygonal cross-section of the cylinder, allowing the movable member to be only linearly movable in the cylinder in opposite directions; and an adjusting bolt having a washer locking groove and inserted into the lower center hole of the connector prior to being lcck̈ed by a split washer inside the connector, said adjusting bolt being threaded into said movable member and being adjustable by a user outside the connector.

14. The one-touch assembling collapsible tent frame according to claim 1, further comprising:

a rib coupling means for detachably coupling the side pole ribs to the sliders, and the center pole ribs to the center pole.

15. The one-touch assembling collapsible tent frame according to claim 14, wherein said rib coupling means comprises:

two brackets, each bracket having a longitudinal guide slit, and mounted to the side pole slider with a seat being formed between the two brackets; and a rib connection block hinged to the two side pole ribs and movably seated in said seat of the two brackets to couple the two side pole ribs to the side pole slider, wherein said rib connection block is movable under the guidance of said guide slits of the two brackets, thus allowing an interval between lower portions of the side poles to be wider than an interval between upper portions of the side poles when stretching the tent frame.

16. The one-touch assembling collapsible tent frame according to claim 14, wherein said rib coupling means comprises:

a spring-biased locking member provided at each end of said side and center pole ribs for detachably coupling each of said ribs to the tent frame, said locking member comprising two locking buttons biased by a compression coil spring and seated in a transverse hole of each rib in a way such that the locking buttons are normally projected from both side surfaces of each rib through said transverse hole and are selectively retracted into the transverse hole when they are pressed.

17. The one-touch assembling collapsible tent frame according to claim 14, wherein said rib coupling means comprises:

socket-type hinge pins, each of said socket-type hinge pins having a pin insert hole and being inserted into a pin hole of the tent frame prior to inserting a metal pin into said pin insert hole.

18. The one-touch assembling collapsible tent frame according to claim 14, wherein said center pole is spring biased and telescopic and further comprises:

a spring-biased and telescopic center pole coupled to the joints of said side pole ribs through a plurality of center pole ribs, wherein said center pole comprises:

a cylinder having a polygonal cross-section;

a connector integrated with a lower end of said cylinder so as to close the lower end of the cylinder;

a tension member movably fitted in said cylinder and biased upwardly by a spring, to stretch and sustain a roof of a tent; and tension adjusting means for selectively adjusting an elasticity of said spring, said means disposed outside of the center pole.

19. The one-touch assembling collapsible tent frame according to claim 14, further comprising slider locking means for selectively locking the slider to the side pole.

* * * * *